US009522685B2

(12) United States Patent
Cooper et al.

(10) Patent No.: US 9,522,685 B2
(45) Date of Patent: Dec. 20, 2016

(54) SYSTEM AND METHOD FOR CONFIGURING AND UPDATING WAYSIDE DEVICES

(71) Applicant: General Electric Company, Schenectady, NY (US)

(72) Inventors: Jared Klineman Cooper, Melbourne, FL (US); Aric Albert Weingartner, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 136 days.

(21) Appl. No.: 14/514,809

(22) Filed: Oct. 15, 2014

(65) Prior Publication Data

US 2016/0107663 A1 Apr. 21, 2016

(51) Int. Cl.

| | |
|---|---|
| ***B61L 25/02*** | (2006.01) |
| ***B61L 27/04*** | (2006.01) |
| ***B61L 27/00*** | (2006.01) |

(52) U.S. Cl.

CPC ..... *B61L 25/02* (2013.01); *B61L 27/0088* (2013.01)

(58) Field of Classification Search

CPC ..... B61L 1/00; B61L 1/02; B61L 3/00; B61L 3/08; B61L 7/00; B61L 7/06; B61L 7/061; B61L 7/08; B61L 23/00; B61L 23/08; B61L 23/14; B61L 23/16; B61L 25/00; B61L 25/02

USPC ... 246/2 R–5, 167 R, 186–187 B; 701/19, 20

See application file for complete search history.

(56) References Cited

U.S. PATENT DOCUMENTS

| | | | | |
|---|---|---|---|---|
| 7,315,770 | B2 | 1/2008 | Wade et al. | |
| 8,702,043 | B2 | 4/2014 | Daum et al. | |
| 2009/0212168 | A1 | 8/2009 | Kumar | |
| 2012/0074266 | A1* | 3/2012 | Daum | B61L 3/20 246/186 |

* cited by examiner

*Primary Examiner* — R. J. McCarry, Jr.

(74) *Attorney, Agent, or Firm* — John A. Kramer; Global Patent Operation

(57) ABSTRACT

Methods and systems relate to establishing a communication link with a wayside device, determining whether or not to at least one of update or configure the wayside device in dependence upon at least one update parameter, and when it is determined to update or configure the wayside device, updating or configuring the wayside device from a remote location.

19 Claims, 2 Drawing Sheets

SYSTEM AND METHOD FOR CONFIGURING AND UPDATING WAYSIDE DEVICES

FIELD OF THE INVENTION

Embodiments of the invention relate generally to wayside devices. Other embodiments relate to a system and method for remotely configuring and updating wayside devices.

BACKGROUND OF THE INVENTION

Railroad companies operate trains and control railroad traffic on track systems that may include thousands of miles of railroad tracks. In order to control the movement of trains on a track system in an efficient and safe manner, railroad companies may utilize a movement planner. The movement planner may include, or reference, a track database that contains information relating to track topography, which is also referred to as the track profile data. The track profile data stored in the database includes, among other things, grade data, track curvature data, and geographic coordinates of various points or segments of the track. In addition to the track profile data, the movement planner takes into account a list of scheduled activities, such as the times associated with origination, termination, crew change, engine change, train stop, assigned work, inspection and the like.

Based on the scheduled activities and the track profile data stored in the track database, the movement planner generates events such as meets, passes, railroad crossing at grade, planned hold, and safe space. A meet-pass involves planning the meet locations where trains traveling in opposite directions can get past each other. It also involves determining the pass locations where a fast train can get past a slower train traveling in the same direction.

In connection with the above, certain vehicle routes are outfitted with wayside signal devices that influence the travel of rail vehicles within the track system. Wayside devices may include signals, switches and/or control devices for railroad operations housed within one or more enclosures located along the railroad right of way. Such devices are controllable to provide information to vehicles and vehicle operators traveling along the route. For example, a typical traffic control signal device might be controllable to switch between an illuminated green light, an illuminated yellow light, and an illuminated red light, which might be understood in the traffic system to mean "ok to proceed," "prepare to stop," and "stop," respectively, for example.

At certain times, it may be desirable to update the software of the wayside devices or to alter the configuration of one or more of such devices. To ensure safety, however, updating and configuring the devices may only be carried out when there are no assets in the area. Accordingly, updating and configuring such devices typically involves sending a technician to the location of the device to be updated, manually inspecting the track to ensure it is clear, communicating with a central office by radio to ensure there are no assets in the area or expected in the area within an predetermined window, and manually pushing a software update to the device after establishing a physical communication link with the device. As will be readily appreciated, however, this process is inefficient, time consuming and requires substantial manpower to service the large number of devices along thousands of miles of tracks.

BRIEF DESCRIPTION OF THE INVENTION

An embodiment of the invention relates to a method. The method includes the steps of establishing a communication link with a wayside device, determining whether or to at least one of update or configure the wayside device in dependence upon at least one update parameter, and if it is determined to update or configure the wayside device, updating or configuring the wayside device from a remote location.

In another embodiment, a method includes the steps of, with a movement planner of a vehicle network, assessing whether or not it is safe to update a wayside device within the vehicle network in dependence upon at least one parameter and remotely uploading software to the wayside device if it is determined by the movement planner that it is safe to update the wayside device. The movement planner is configured to determine a location of a vehicle within the network and to at least one of schedule or control movement of the vehicle within the network. The at least one parameter includes the location of the vehicle in relation to the wayside device.

In yet another embodiment, a system includes a movement planning system including a control unit and a first transceiver electrically connected to the control unit. The movement planning system is configured to determine a location of a vehicle within a vehicle network and to at least one of control or schedule movement of the vehicle within the network. The control unit of the movement planning system is configured to establish a communication link with a second transceiver of a wayside device within the vehicle network, to determine whether to at least one of update or configure the wayside device in dependence upon at least one parameter of the vehicle network, and to at least one of update or configure the wayside device remotely.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
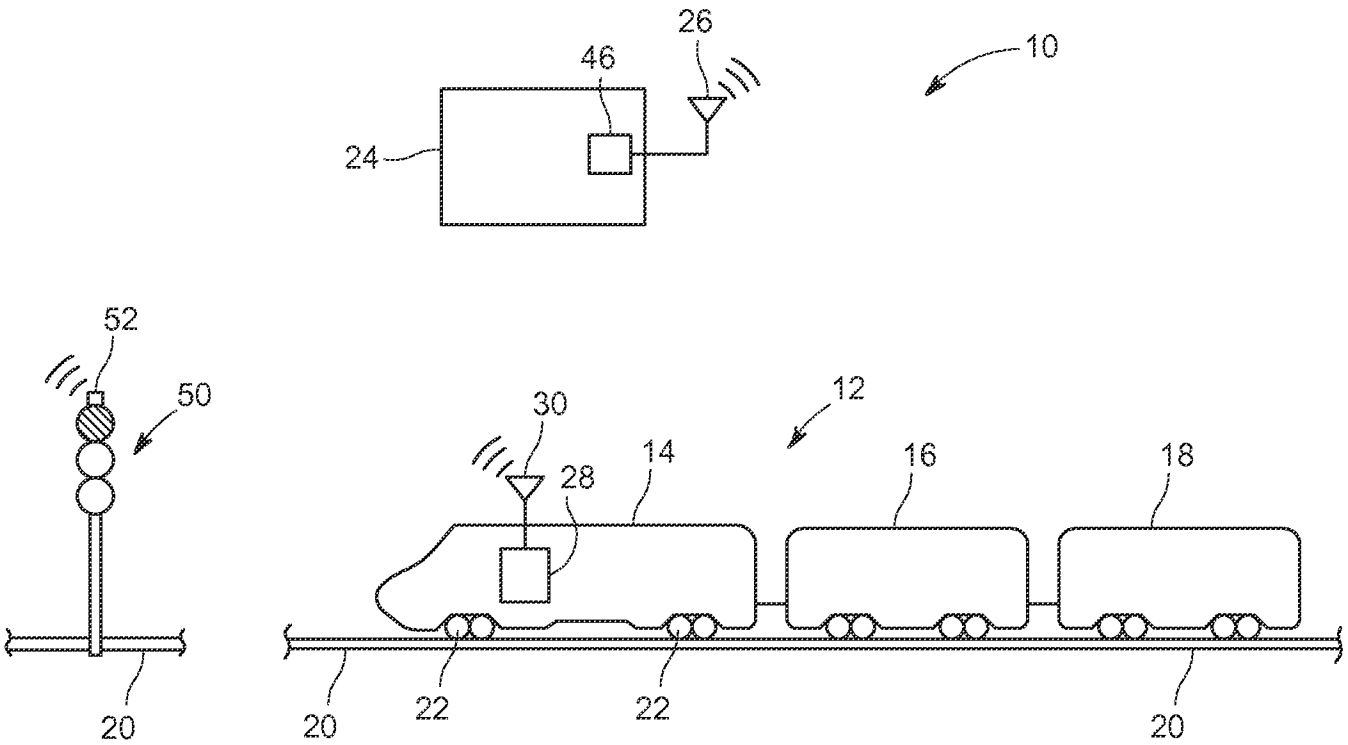
FIG. 1 is a schematic illustration of a system for configuring and updating wayside devices, according to an embodiment of the invention.

Reference will be made below in detail to exemplary embodiments of the invention, examples of which are illustrated in the accompanying drawings. Wherever possible, the same reference numerals used throughout the drawings refer to the same or like parts. Embodiments of the invention relate to a inspection system and method. As used herein, "rail vehicle" can be a locomotive, switcher, shunter, and the like and includes both freight haulage and passenger locomotives, which themselves may be diesel electric or all electric, and that may run on either AC or DC electric power. "Wayside equipment" or "wayside device" refers to crossing-gates, crossing-gate lights, related right of way equipment, track circuit monitoring devices, switches and other rail equipment that is located along side the track. As used herein, "electrically connected" means that the referenced elements are directly or indirectly connected such that an electrical current may flow from one to the other. The connection may include a direct conductive connection (i.e., without an intervening capacitive, inductive or active element), an inductive connection, a capacitive connection, and/or any other suitable electrical connection. Intervening components may be present.

Embodiments of the invention relate to a method for configuring and updating wayside devices. The method includes the steps of establishing a communication link with a wayside device, determining whether or not it is safe to update and/or configure the wayside device in dependence upon at least one update parameter, and when it is determined that it is safe to update and/or configure the wayside device, updating and/or configuring the wayside device from a remote location.

Other embodiments of the invention relate to a method for configuring and updating wayside devices. The method includes the steps of, with a movement planner of a vehicle network, assessing whether or not it is safe to update a wayside device within the vehicle network in dependence upon at least one parameter and remotely uploading software to the wayside device if it is determined by the movement planner that it is safe to update the wayside device. The movement planner is configured to determine a location of a vehicle within the network and to at least one of schedule or control movement of the vehicle within the network. The at least one parameter includes the location of the vehicle in relation to the wayside device.

Yet other embodiments of the invention relate to a system for configuring and updating wayside devices. The system includes a movement planning system including a control unit and a first transceiver electrically connected to the control unit. The movement planning system is configured to determine a location of a vehicle within a vehicle network and to at least one of control or schedule movement of the vehicle within the network. The control unit of the movement planning system is configured to establish a communication link with a second transceiver of a wayside device within the vehicle network, to determine whether to at least one of update or configure the wayside device in dependence upon at least one parameter of the vehicle network, and to at least one of update or configure the wayside device remotely.

With reference to FIG. 1, according to an embodiment, a system 10 and method for configuring and updating wayside devices is illustrated. As shown therein, the system 10 may include a vehicle consist 12 comprising a plurality of rail vehicles, such as rail vehicles 14, 16, and 18 configured to run on a track 20. In an embodiment, the track 20 is part of a larger rail network across which many rail vehicles may travel. One or more of the rail vehicles may be powered units capable of self-propulsion, while one or more of the vehicles may be non-powered units mechanically and/or logically inked together to form the train or other vehicle consist 12. For example, rail vehicle 14 may be a locomotive configured to run on the track 20 via a plurality of wheels 22. The rail vehicle 14 includes an engine, such as an internal combustion engine. A plurality of traction motors (not shown) are mounted on a truck frame and are each connected to one of a plurality of wheels 22 to provide tractive power to propel and retard the motion of the rail vehicle 14. The traction motors may receive electrical power from a generator to provide tractive power to the rail vehicle 14. As illustrated, rail vehicles 16 and 18 are mechanically coupled to the locomotive 14 and are non-powered units.

In an embodiment, the consist 12 and other rail vehicles travel along routes according to a movement plan of the system 10. The movement plan coordinates movement of the all the vehicles within the rail network. For example, the movement plan may include schedules for the vehicles to move from a starting location or a current location to a destination location at a scheduled arrival time. In one embodiment, the movement plan may include a list, table, or other logical arrangement of scheduled geographic locations (e.g., Global Positioning System coordinates) within the system and associated scheduled arrival times. The vehicles move along various paths within the rail network to arrive at the scheduled locations at the associated scheduled arrival times. The scheduled locations in the movement plan can be referred to as "scheduled waypoints."

In an embodiment, the movement plan may be determined by a movement planner or movement control system 24. As shown in FIG. 1, the movement control system 24 can be disposed off-board (e.g., outside) of the vehicles 14, 16, 18. For example, the movement control system 24 may be disposed at a central dispatch office for a railroad company. The movement control system 24 can create and communicate the schedules to the vehicles within the rail network, such as to locomotive 14. The movement control system 24 can include a wireless antenna 26 (and associated transceiving equipment), such as a radio frequency (RF) or cellular antenna, that wirelessly transmits the schedules and other information and data to the vehicles and wayside devices, as discussed in detail hereinafter. For example, the movement control system 24 may transmit destination locations and associated arrival times to the vehicles within the network.

In an embodiment, the movement control system 24 includes a controller 46, such as a computer processor or other logic-based device that performs operations based on one or more sets of instructions (e.g., software). The instructions on which the controller 46 operates may be stored on a tangible and non-transitory (e.g., not a transient signal) computer readable storage medium, such as a memory. The memory may include one or more computer hard drives, flash drives, RAM, ROM, EEPROM, and the like. The movement control system 24 includes several modules that perform various operations described herein.

The movement control system 24, as discussed above, can monitor travel of the vehicles in the rail network. In an embodiment, the vehicles may periodically report current positions of the vehicles to the system 24, as discussed in detail below, so that the system 24 can track where the vehicles 24 are located. In an embodiment, wayside devices (e.g., signals or other sensors disposed alongside the routes of the network) can periodically report the passing of vehicles by the signals or sensors to the movement control system 24. The movement control system 24 receives the locations of the vehicles in order to monitor where the vehicles are in the rail network over time.

Figure 2:
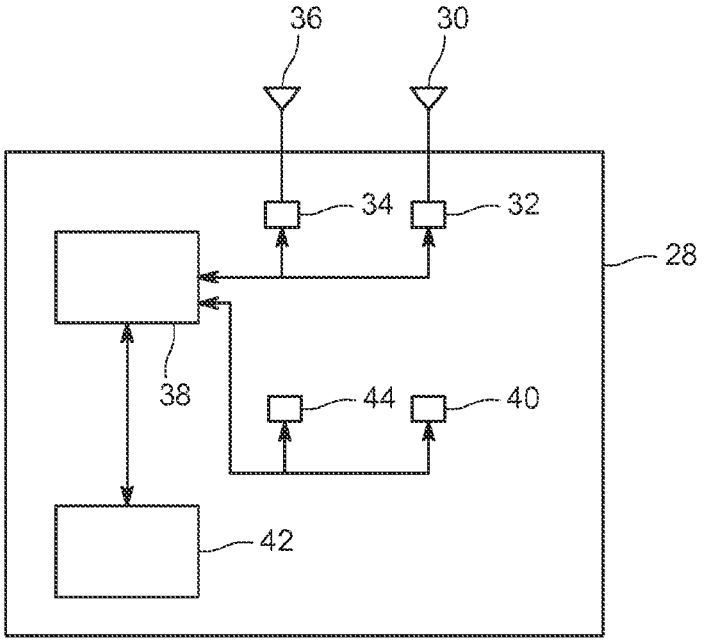
FIG. 2 is a schematic diagram of a control system of a vehicle that may form a part of the system of FIG. 1.

Turning now to FIG. 2, at least one of the rail vehicles 14 within the consist 12 includes an on-board control system 28. The control system 28 receives the schedules from the movement control system 24 and generates control signals that may be used to control propulsion of the vehicle 14 through the rail network. For example, the vehicle 14 may include a wireless antenna 30, such as RF or cellular antenna, electrically connected to a receiver 32, that receives the schedules from the movement control system 24. On each vehicle, the wireless antenna 30 communicates the received schedule to the control system 28 that may be disposed on-board the vehicle 14. The control system 28 examines the schedule, such as by determining the scheduled destination location and scheduled arrival time, and generates control signals based on the schedule. With further reference to FIG. 2, the control system 28 may also include a positioning system 34 having an antenna 36 that is configured to continuously or intermittently communicate a position of the vehicle 14 within the rail network to the movement control system 24. In an embodiment, a single antenna and transceiver may be utilized to receive information from the movement control system 24 and other devices as well as to communicate a position of the consist 12 to the movement control system 24. Both the positioning system 34 and the receiver 32 are in communication with, i.e., able to pass data to, a control unit such as computer 38.

As indicated above, the control system 28 may receive the trip plan from the movement control system 24 and generate the control signals that automatically change the tractive efforts and/or braking efforts of the vehicle 14 based on the trip plan. In particular, in an embodiment, the control unit 38 may be in communication with the braking system 40, which is configured to automatically brake the vehicle 14 based upon the determined vehicle location, signals received from wayside devices, etc. In addition, and as is known in the art, a display 42 can be provided in the vehicle 14 for use in presenting information and data to the operator. For example, the display 42 may present estimated location, track location data, wayside device state data, wayside device status data, wayside device change data, wayside device behavior data, wayside device location data, direction of travel, etc.

Lastly, the control system 28 on-board the vehicle 14 may include at least one warning device 44, which is in communication with the computer 38 and which is capable of providing the operator with some visual and/or audible warning or alarm.

Turning back to FIG. 1, the system 10 includes at least one wayside 50 device positioned along the track 20. As illustrated, the wayside device 50 may be a signal device. As is known in the art, the wayside devices 50 are used to assist the train operator in determining how the locomotive 14 should be controlled on any particular track. For example, and as is known in the art with respect to signal devices, various symbols, colors and other visual indicators are used to provide the train operator with information for use in operating the train locomotive 14 (and consist 12, as a whole). For example, the colors of green, yellow and red (and associated data) may be used to indicate how the locomotive 14 is permitted to operate. For example, the color green often means clear, such that the locomotive 14 may proceed without restriction, while the color yellow may indicate that some caution or control is required. Further, the color red normally indicates that the locomotive 14 must stop (whether automatically or manually) prior to proceeding by the signal device 50.

As alluded to above, the wayside device 50 includes a transceiver 52. The transceiver 52 is configured to communicate information relating to the wayside device 50 to the control system 28 on-board the vehicle 14, as well as to the movement control system 24. For example, the wayside device 50 is configured to communicate wayside device state data, wayside device status data, wayside device change data, wayside device behavior data, wayside device location data, etc. to both the vehicle 14 and movement control system 24.

Figure 3:
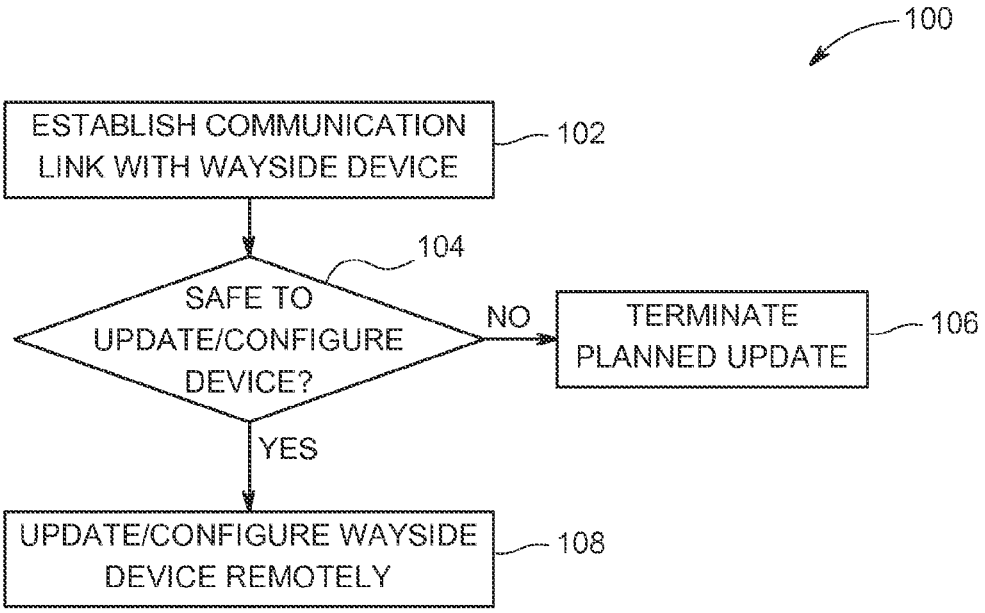
FIG. 3 is a flowchart illustrating a method for configuring and updating wayside devices, according to an embodiment of the invention.

In an embodiment, the system 10 is configured to update the software and/or configure the wayside devices within the rail network remotely. For example, in an embodiment, the wayside device 50 may be updated or configured from a central office such as by the controller 46 of the movement control unit 24 or other control unit. With reference to FIG. 3, a method 100 carried out by a control unit located remote from a wayside device (such as the controller 46 of movement control unit 24) to update and/or configure such wayside device, is illustrated.

As shown in FIG. 3, at step 102, the controller 46 establishes a communication link with the wayside device 50 (e.g., through wireless antenna 26 of the movement control system 24 and the transceiver 52 of the wayside device 50). As used herein, the phrase "communication link" may refer to any connection, wire, port, device, and/or signal and/or any transmission, exchange, repeating, and/or other flow of information or data that is processed by an entity, and/or that is shared or exchanged between two or more people, devices, and/or other entities. Once the communications link is established, the controller 46 determines whether or not it is safe to update and/or configure the wayside device 50, at step 104, in dependence upon at least one update parameter. In embodiments, the update parameter may include a location of one or more vehicles on the track, a state of the wayside device, a status of the wayside device, and/or the state, operation or function of a switch (where the wayside device is a switch).

In an embodiment, the at least one update parameter is the location of rail vehicles in relation to the wayside device 50 to be updated. In particular, determining whether or not it is safe to update and/or configure the device includes determining whether or not any vehicle, such as vehicle 14, is a predetermined minimum distance from the wayside device 50. For example, if the nearest vehicle is verified to be greater than 5 miles away from the device to be updated, the controller 46 may proceed with the update/configuration. If, however, the nearest vehicle is verified to be within 5 miles from the device to be updated, and approaching, the controller 46 will not proceed. In an embodiment, the controller 46 of the movement control system 24 may assign a label to vehicles within the rail network with respect to a particular wayside device to be updated. If a vehicle is within a predetermined distance of the device, the vehicle may assigned 'on the device' status, in which case the controller 46 will not allow the wayside device to be updated or configured. If a vehicle is outside of the predetermined distance but may be within the predetermined distance before the update is complete, the vehicle may be assigned 'could be on the device' status, in which case the controller 46 may still not allow the device to be updated. Finally, if a vehicle is outside of the predetermined distance window and will not enter the window before the update is completed, the vehicle may be assigned 'completely clear' status, in which case the controller 46 may proceed with the update or verify that other update parameters are cleared and acceptable before proceeding.

In an embodiment, the at least one update parameter may be a state of the wayside device 50, e.g., an indication of a track condition or occupancy (i.e., whether or not the track is completely clear). For example, where the wayside device is a track switch, the switch must be determined to be in a neutral 'straight state' before proceeding with updating/configuration. If the switch is not functional or is not in the proper orientation, the controller 46 will not proceed with the update. As will be readily appreciated, ensuring that the device 50 is in a proper state to receive an update helps ensure that the device operates properly after updating and after reboot. In an embodiment, the at least one update parameter is a status of the wayside device wayside device, e.g., whether the control unit of the wayside device 50 is operational.

As will be readily appreciated, if any of these status checks fail, the wayside device 50 will not be updated and the planned update will be terminated, at step 106. If, however, all of the status checks pass (e.g., it is determined that the track is clear of vehicles, work crews and the like, and the device to be updated passes status, state and/or operations checks), then the controller 46 will push the software update or configuration to the wayside device remotely, at step 108. In an embodiment, updating the wayside device includes pushing software to the wayside device from a remote location. In an embodiment, the software is a set of machine-readable instructions that directs the control unit of the device to perform various operations and may include bug fixes and the like. In an embodiment, updating and configuring the wayside device may include uploading software to, and downloading software or information from, the wayside device.

As will be readily appreciated, the system and method of the present invention allows wayside devices to be updated from a "remote location," i.e., from a location distant from the wayside device (such as from a central office of a railroad company). This is made possible by the utilization of the movement planner/movement control system as the vital link within the system to verify that it is safe to proceed with the update or configuration of the device. Indeed, in addition to utilizing the movement planner to control the movement of assets within the rail network, the movement planner may also be utilized as the vital link within the system 10 of the present invention to assess whether or not, from a safety, vital perspective, wayside devices maybe updated from a remote location. This is in contrast to existing systems and methods, where a human technician serves as the vital link and is required to physically go to the location of the wayside device to verify that the track is clear and the device is in the proper state for receiving software updates. By verifying that it is safe to proceed with a software update utilizing the movement planner, the need to send technicians to remote locations over thousands of miles of track is obviated. Accordingly, man-hours and significant cost savings relating to wayside device updating, maintenance and configuration can be realized.

An embodiment of the present invention relates to a method. The method includes the steps of establishing a communication link with a wayside device, determining whether or not it is safe to at least one of update or configure the wayside device in dependence upon at least one update parameter, and when it is determined that it is safe to update or configure the wayside device, updating or configuring the wayside device from a remote location.

In an embodiment, the steps of establishing a communication link and determining whether or not to update or configure the wayside device are carried out by a movement planner of a vehicle network, the movement planner being configured to determine a location of a vehicle within the network and to at least one of schedule or control the movement of the vehicle within the network.

In an embodiment, the at least one update parameter includes the location of the vehicle in relation to the wayside device. In an embodiment, the movement planner may utilize a global positioning system to determine the location of the vehicle. In an embodiment, determining whether or not to update and/or configure the wayside device includes determining if the vehicle is outside of a predetermined distance from the wayside device.

In an embodiment, the at least one update parameter includes a status of the wayside device including whether or not a control unit of the wayside device is operational.

In an embodiment, the wayside device is a track switch. In an embodiment, the wayside device is one of a crossing-gate, a crossing-gate light, a right-of-way device, a track circuit monitoring device or a track switch.

In an embodiment, the method may also include the step of terminating a scheduled update if it is determined that the at least one update parameter does not meet a threshold condition or value.

In an embodiment, updating and/or configuring the wayside device includes uploading software to the wayside device.

In an embodiment, the wayside device includes a wayside device transceiver and the movement planning system includes a movement planning transceiver, the communication link is established between the wayside device and the movement planning system, and the software is uploaded to the wayside device via the communication link.

In another embodiment, a method is provided. The method includes the steps of, with a movement planner of a vehicle network, assessing whether or not it is safe to update a wayside device within the vehicle network in dependence upon at least one parameter and remotely uploading software to the wayside device if it is determined by the movement planner that it is safe to update the wayside device. The movement planner is configured to determine a location of a vehicle within the network and to at least one of schedule or control movement of the vehicle within the network. The at least one parameter includes the location of the vehicle in relation to the wayside device.

In an embodiment, the method may also include the step of establishing a wireless communication link with the wayside device prior to assessing whether to update and prior to remotely uploading the software to the wayside device.

In an embodiment, the step of assessing whether to update the wayside device in dependence upon the location of the vehicle in relation to the wayside device includes determining if the vehicle is outside of a predetermined distance from the wayside device.

In an embodiment, the at least one parameter includes a status of the wayside device, the status including whether a control unit of the wayside device is operational.

In an embodiment, the wayside device is one of a crossing-gate, a crossing-gate light, a right-of-way device, a track circuit monitoring device, or a track switch.

In yet another embodiment, a system is provided. The system includes a movement planning system including a control unit and a first transceiver electrically connected to the control unit. The movement planning system is configured to determine a location of a vehicle within a vehicle network and to at least one of control or schedule movement of the vehicle within the network. The control unit of the movement planning system is configured to establish a communication link with a second transceiver of a wayside device within the vehicle network, to determine whether to at least one of update or configure the wayside device in dependence upon at least one parameter of the network, and to at least one of update or configure the wayside device remotely.

In an embodiment, the at least one parameter includes the location of the vehicle in relation to the wayside device. In an embodiment, the movement planning system utilizes a global positioning system to determine the location of the vehicle.

In an embodiment, the update comprises a software update of the wayside device, the control unit being configured to push the software update to the wayside device remotely. The control unit of the movement planning system may configured to determine if the vehicle is outside of a predetermined distance from the wayside device and to push the software to the wayside device only if it is determined that the vehicle is outside of the predetermined distance from the wayside device.

In an embodiment, the at least one parameter includes a status of the wayside device, the status including whether or not a control unit of the wayside device is operational.

In an embodiment, the wayside device is one of a crossing-gate, a crossing-gate light, a right-of-way device, a track circuit monitoring device, or a track switch.

In another embodiment, a method comprises, with a movement planner of a vehicle network, assessing if one or more parameters associated with a wayside device along a route of the vehicle network are met. The method further comprises, with the movement planner, at least one of remotely updating or remotely configuring the wayside device only if all of the one or more parameters are met. For example, the one or more parameters may comprise one or more of no vehicles being within a first designated distance of the wayside device, no vehicles being within a greater, second designated distance and traveling along the route towards the wayside device, no vehicles being scheduled to enter within a third designated distance of the wayside device within a designated time threshold, no vehicles being able to enter within a fourth designated distance of the wayside device if traveling at a maximum allowed speed along the route for a designated time, a control unit of the wayside device being operational, and/or the control unit being in a designated mode of operation. (The designated distances may be the same or different from one another, although as noted, the second designated distance, in an embodiment, is greater than the first designated distance.) These parameters reflect, respectively, that in embodiments, the wayside device is not configured or updated when vehicles are relatively very close to the wayside device, when vehicles are relatively further away from the wayside device but are moving towards the wayside device, when vehicles are scheduled to be relatively near the wayside device within a relatively short time (e.g., less time than required to update or configure the wayside device), when vehicles traveling at the speed limit will be relatively near the wayside device within a relatively short time (e.g., less time than required to update or configure the wayside device), when the wayside device is not operational for updates or configuring, and/or when the wayside device is operating in a mode of operation where it cannot be updated or configured or should not be configured or updated for designated safety reasons.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The terms "including" and "in which" are used as the plain-English equivalents of the respective terms "comprising" and "wherein." Moreover, the terms "first," "second," "third," "upper," "lower," "bottom," "top," etc. are used merely as labels, and are not intended to impose numerical or positional requirements on their objects.

This written description uses examples to disclose several embodiments of the invention, including the best mode, and also to enable one of ordinary skill in the art to practice the embodiments of invention, including making and using any devices or systems and performing any incorporated methods.

As used herein, an element or step recited in the singular and proceeded with the word "a" or "an" should be understood as not excluding plural of the elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the embodiments described herein without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A method, comprising the steps of:

establishing a first communication link with a wayside device;

establishing a second communication link with a vehicle;

determining whether or not to at least one of update or configure the wayside device in dependence upon at least one update parameter, the at least one update parameter including a location of the vehicle in relation to the wayside device; and if it is determined to update or configure the wayside device, updating or configuring the wayside device from a remote location over the first communication link;

wherein the steps of establishing the first and second communication links and determining whether or not to update or configure the wayside device are carried out by a movement planner of a vehicle network, the movement planner being configured to determine the location of the vehicle within the network and to at least one of schedule or control movement of the vehicle within the network.

2. The method according to claim 1, wherein:

determining whether or not to update or configure the wayside device includes determining if the vehicle is outside of a predetermined distance from the wayside device.

3. The method according to claim 1, wherein:

the at least one update parameter includes a status of the wayside device including whether a control unit of the wayside device is operational.

4. The method according to claim 1, wherein:

the wayside device is a track switch.

5. The method according to claim 1, wherein:

the wayside device is one of a crossing-gate, a crossing-gate light, a right-of-way device, a track circuit monitoring device, or a track switch.

6. The method according to claim 1, further comprising the step of:

terminating a scheduled update if it is determined that the at least one update parameter does not meet a threshold condition or value.

7. The method according to claim 1, wherein:

updating and/or configuring the wayside device includes uploading software to the wayside device.

8. The method according to claim 7, wherein:

the wayside device includes a wayside device transceiver and the movement planning system includes a movement planning transceiver;

the first communication link is established between the wayside device and the movement planning system; and the software is uploaded to the wayside device via the first communication link.

9. The method according to claim 1, wherein:

the at least one update parameter includes an update window defining an amount of time required to update or configure the wayside device; and wherein the wayside device is updated or configured if it is determined that the location of the vehicle will be greater than a predetermined distance from the wayside device for the duration of the update window.

10. A method, comprising the steps of:

with a movement planner of a vehicle network, assessing whether to update a wayside device within the vehicle network in dependence upon at least one parameter, the movement planner being configured to determine a location of a vehicle within the network and to at least one of schedule or control movement of the vehicle within the network; and remotely uploading software to the wayside device if it is determined by the movement planner to update the wayside device;

wherein the at least one parameter includes the location of the vehicle in relation to the wayside device.

11. The method according to claim 10, further comprising the step of:

establishing a wireless communication link with the wayside device prior to assessing whether to update and prior to remotely uploading the software to the wayside device.

12. The method according to claim 10, wherein:

assessing whether to update the wayside device in dependence upon the location of the vehicle in relation to the wayside device includes determining if the vehicle is outside of a predetermined distance from the wayside device.

13. The method according to claim 10, wherein:

the at least one parameter includes a status of the wayside device, the status including whether a control unit of the wayside device is operational.

14. The method according to claim 10, wherein:

the wayside device is one of a crossing-gate, a crossing-gate light, a right-of-way device, a track circuit monitoring device, or a track switch.

15. The method according to claim 10, wherein:

the at least one parameter includes an update window defining an amount of time required to update or configure the wayside device; and wherein the software is remotely uploaded to the wayside device if it is determined that the location of the vehicle will be greater than a predetermined distance from the wayside device for the duration of the update window.

16. A system, comprising:

a movement planning system including a control unit and a first transceiver electrically connected to the control unit, the movement planning system being configured to determine a location of a vehicle within a vehicle network and to at least one of control or schedule movement of the vehicle within the network;

wherein the control unit of the movement planning system is configured to establish a communication link with a second transceiver of a wayside device within the vehicle network;

wherein the control unit of the movement planning system is configured to determine whether to at least one of update or configure the wayside device in dependence upon at least one parameter of the vehicle network including the location of the vehicle in relation to the wayside device; and wherein the control unit of the movement planning system is configured to at least one of update or configure the wayside device remotely.

17. The system of claim 16, wherein:

the update comprises a software update of the wayside device, the control unit being configured to push the software update to the wayside device remotely;

the control unit of the movement planning system is configured to determine if the vehicle is outside of a predetermined distance from the wayside device; and the control unit of the movement planning system is configured to push the software to the wayside device only if it is determined that the vehicle is outside of the predetermined distance from the wayside device.

18. The system of claim 16, wherein:

the at least one parameter includes a status of the wayside device, the status including whether or not a control unit of the wayside device is operational.

19. The system of claim 16, wherein:

the wayside device is one of a crossing-gate, a crossing-gate light, a right-of-way device, a track circuit monitoring device, or a track switch.

* * * * *